US009107471B2

(12) United States Patent
Kitagawa

(10) Patent No.: US 9,107,471 B2
(45) Date of Patent: Aug. 18, 2015

(54) SHOE INSOLE

(71) Applicant: Hiroyuki Kitagawa, Sapporo (JP)

(72) Inventor: Hiroyuki Kitagawa, Sapporo (JP)

( * ) Notice: Subject to any disclaimer, the term of this patent is extended or adjusted under 35 U.S.C. 154(b) by 265 days.

(21) Appl. No.: 13/728,178

(22) Filed: Dec. 27, 2012

(65) Prior Publication Data

US 2013/0167403 A1 Jul. 4, 2013

(30) Foreign Application Priority Data

Dec. 30, 2011 (JP) ..... 2011-290743

(51) Int. Cl.
*A43B 7/14* (2006.01)

(52) U.S. Cl.
CPC . *A43B 7/14* (2013.01); *A43B 7/143* (2013.01); *A43B 7/144* (2013.01); *A43B 7/1405* (2013.01); *A43B 7/149* (2013.01); *A43B 7/1425* (2013.01)

(58) Field of Classification Search
CPC ..... A43B 7/14; A43B 7/1405
USPC ..... 36/43, 44, 140, 173
See application file for complete search history.

(56) References Cited

U.S. PATENT DOCUMENTS

| | | | | |
|---|---|---|---|---|
| 2,423,622 | A * | 7/1947 | Samblanet | 36/176 |
| 2,424,107 | A | 7/1947 | McCahan | |
| 2,426,735 | A | 9/1947 | Hiss | |
| 2,863,231 | A | 12/1958 | Jones | |
| 4,760,655 | A * | 8/1988 | Mauch | 36/44 |
| 5,170,572 | A * | 12/1992 | Kantro | 36/43 |
| 5,784,811 | A * | 7/1998 | Mauch | 36/141 |
| 5,799,414 | A * | 9/1998 | Kellerman | 36/44 |
| 6,247,250 | B1 * | 6/2001 | Hauser | 36/44 |
| D707,937 | S * | 7/2014 | Kitagawa | D2/961 |
| 2004/0103558 | A1 * | 6/2004 | Everz | 36/43 |
| 2007/0033834 | A1 | 2/2007 | Cheskin et al. | |
| 2010/0170107 | A1 * | 7/2010 | Tzeng | 36/28 |
| 2012/0144697 | A1 * | 6/2012 | Everz Vaz | 36/44 |
| 2012/0255199 | A1 * | 10/2012 | Tzeng | 36/43 |

FOREIGN PATENT DOCUMENTS

| | | |
|---|---|---|
| CN | 1067567 | 1/1993 |
| CN | 202477922 | 10/2012 |
| GB | 217833 | 6/1924 |
| JP | 9-140405 | 6/1997 |
| JP | 2000-166604 | 6/2000 |
| JP | 2010-017514 | 1/2010 |
| JP | 3171384 | 10/2011 |

OTHER PUBLICATIONS

Co-pending U.S. Appl. No. 29/449,156, entitled Shoe Insole, filed Mar. 14, 2013, 7 pages total.
Partial European Search Report issued Mar. 12, 2014 in related European patent application No. 13156394.2 (4 pages total).
Office Action from corresponding Chinese patent application, dated Jun. 16, 2015, and English translation (18 pages total).

* cited by examiner

*Primary Examiner* — Marie Bays
(74) *Attorney, Agent, or Firm* — Hamre, Schumann, Mueller & Larson, P.C.

(57) ABSTRACT

A shoe insole, which supports three points on a sole to stabilize a center of gravity, is provided by considering a skeletal structure of a foot and a sequential movement from foot joints to a body. The three points, which are a first metatarsal sesamoid bone, tuberosity of fifth metatarsal bone, and a calcaneal tuberosity, are supported from a sole side, and the three point balance can stabilize a center of gravity, and thereby a stimulus that adjusts body movements derived from a sole to help a body to be back to a right position can be given.

2 Claims, 7 Drawing Sheets

SHOE INSOLE

BACKGROUND OF THE INVENTION

1. Field of the Invention

The present invention relates to a shoe insole. More particularly, the present invention relates to a shoe insole supporting a sole at three points thereof, so that a stable center of gravity and suitable movements are made possible.

2. Description of the Related Art

Although some shoe insoles are used mainly for deodorizing and comforting purposes, a shoe insole of the present invention is considering of balancing to keep a right position and adjust a center of gravity for functional movements.

When foot joints are distorted, skeletal, muscular, and nervous systems may adversely be affected. Skeletal systems are affected, such that when basal foot joints are distorted, differences in heights will be made to the right and left pelvises, which may subsequently cause scoliosis to a backbone. The scoliosis of a backbone may cause a variety of systemic impairments, such as neurological disorders, blood circulation failure, visceral disorders and the like.

Muscular systems are affected, such that when foot joints are distorted, standing in a relaxed manner will be impossible, since muscles are overworking to compensate the unbalance. Therefore, muscles are always tensed and thereby lactic acid, which is a fatigue substance, is accumulated to cause fatigue. If such the situation is persisted, muscles are cured, blood circulation failure is occurred, and finally chronic stiff shoulder and headache may be induced.

Nervous systems are affected, such that when a backbone is distorted, subsequently nerves are compressed. Such compression may cause disability of neurotransmission, since nerves run from a backbone through a whole body. Moreover, when a backbone is distorted, organs will also be compressed, and thereby visceral disorders may also be induced. If such uncomfortableness is persisted, stresses will be accumulated, and then the chronic stresses will cause an unbalance between sympathetic nerves and parasympathetic nerves, which may affect to hormonal secretion.

FIG. 2 illustrates adverse effects caused by distortions of basal foot joints.

[Patent Literature 1]

Japanese Unexamined Patent Application No. 9-140405

[Patent Literature 2]

Japanese Unexamined Patent Application No. 2000-166604.

SUMMARY OF THE INVENTION

It is an object of the present invention to provide an insole by which suitable movements and a stable balance are made possible. For this object, an insole of the present invention is completed by considering skeletons, foot joint movements, and a center of gravity when feet are grounded, so that a three point balance in which a first metatarsal sesamoid bone, a tuberosity of fifth metatarsal bone, and a calcaneal tuberosity are used as supporting points is constituted.

An object of the insole described in the Patent Literature 1 is to prevent hallux valgus. The insole has concave and convex portions to fix a foot in a shoe without movements, and thereby hallux valgus will be prevented.

However, in the insole described in the Patent Literature 1, structures of foot joints are not considered, and the insole is not designed to support particular sites, and allow suitable movements.

An object of the insole described in the Patent Literature 2 is to correct flat foot. In the insole, a circular evaluated member is placed in a middle portion thereof to raise a navicular bone and cuneiform bones to correct flat foot.

However, as with the Patent Literature 1, in the insole described in the Patent Literature 2, structures of foot joints are not considered, and it is not designed to support particular sites, and does not allow suitable movements.

The present invention provides a shoe insole that is restrained from moving and fitted on inside of a shoe to support a sole, in which the insole has convex portions that supports a first metatarsal sesamoid bone, a tuberosity of fifth metatarsal bone, and a calcaneal tuberosity from a sole side when the insole restrained from moving and is fitted in the shoe.

An insole of the present invention has a planar contour shape whose outer edge is fitted along with an edge of the inside of a shoe, so that the insole can be on a certain position when placed into the shoe. A three-dimensional shape of the insole has convex portions on particular positions. The convex portions are located on positions that support a first metatarsal sesamoid bone, a tuberosity of fifth metatarsal bone, and a calcaneal tuberosity from a sole side. This three point balance is most preferable, since it is the most stable manner of support as shown by tripod stands. According to the present invention, sequential disabilities caused by distortions of basal foot joints can be eliminated.

According to the present invention, a shoe insole, which supports a sole at three points thereof, so that a stable center of gravity and suitable movements are made possible can be provided.

In particular, the shoe insole can improve functional movements as it supports a sole at appropriate positions for three point balancing, which stabilizes a center of gravity and keeps a right position. In addition, an insole of the present invention can eliminate sequential disabilities caused by distortions of basal foot joints.

DETAILED DESCRIPTION OF THE PREFERRED EMBODIMENTS

Hereinafter, an embodiment of an insole according to the present invention will be explained by reference to the figures.

Figure 1:
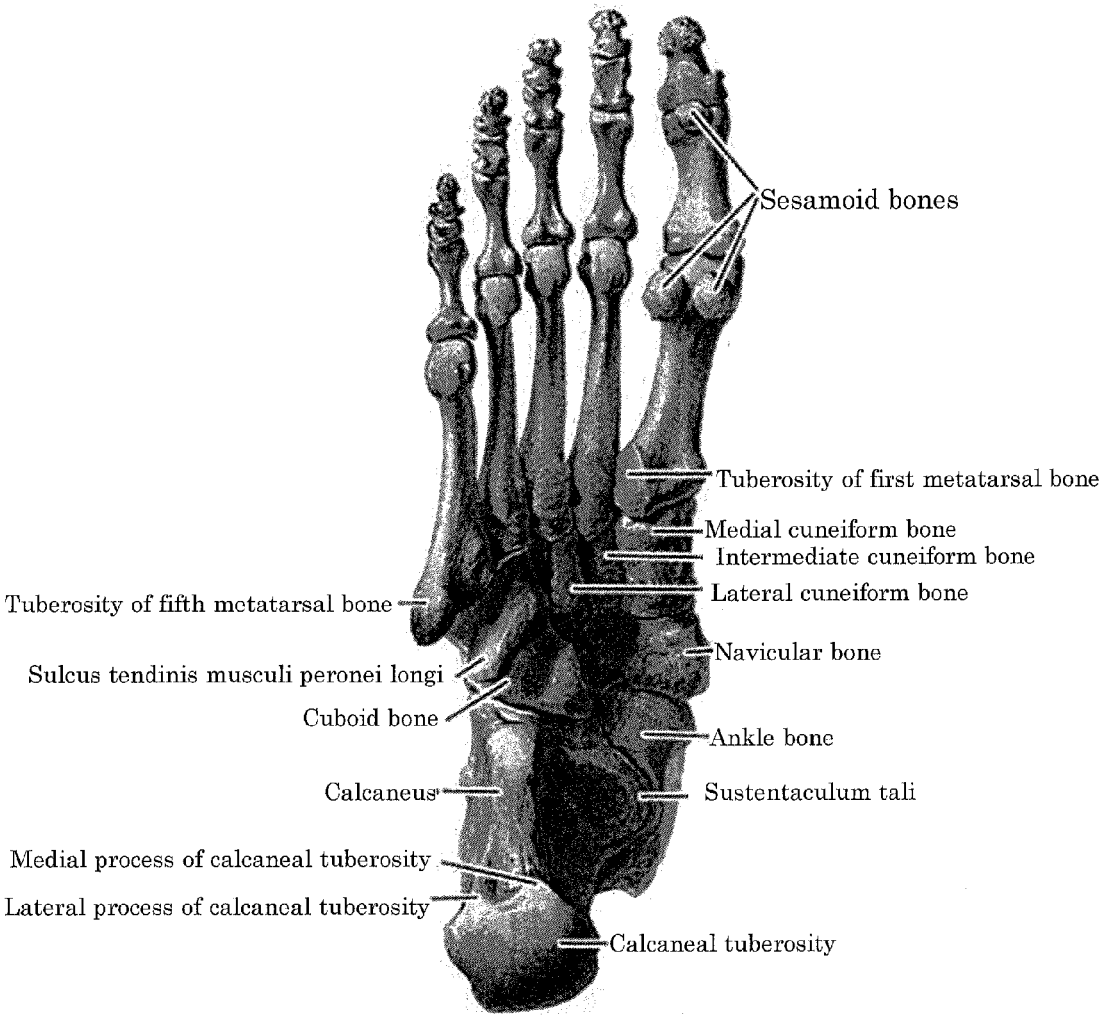
FIG. 1 is a plan view illustrating bones of a right sole.
Figure 2:
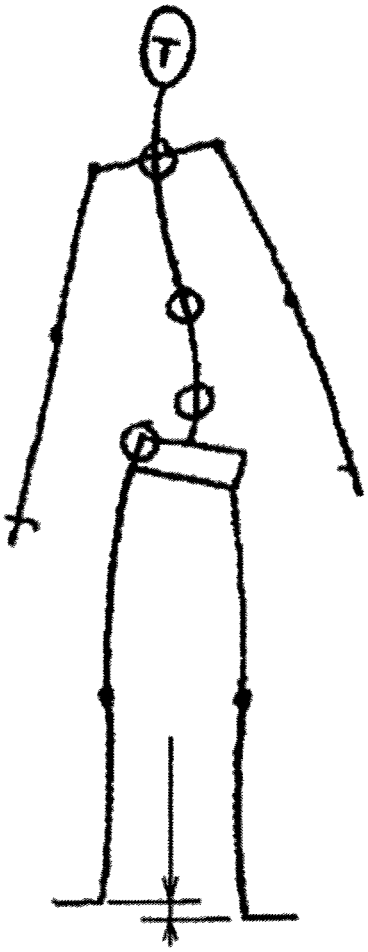
FIG. 2 is a schematic drawing illustrating adverse effects caused by distortions of foot joints.
Figure 3:
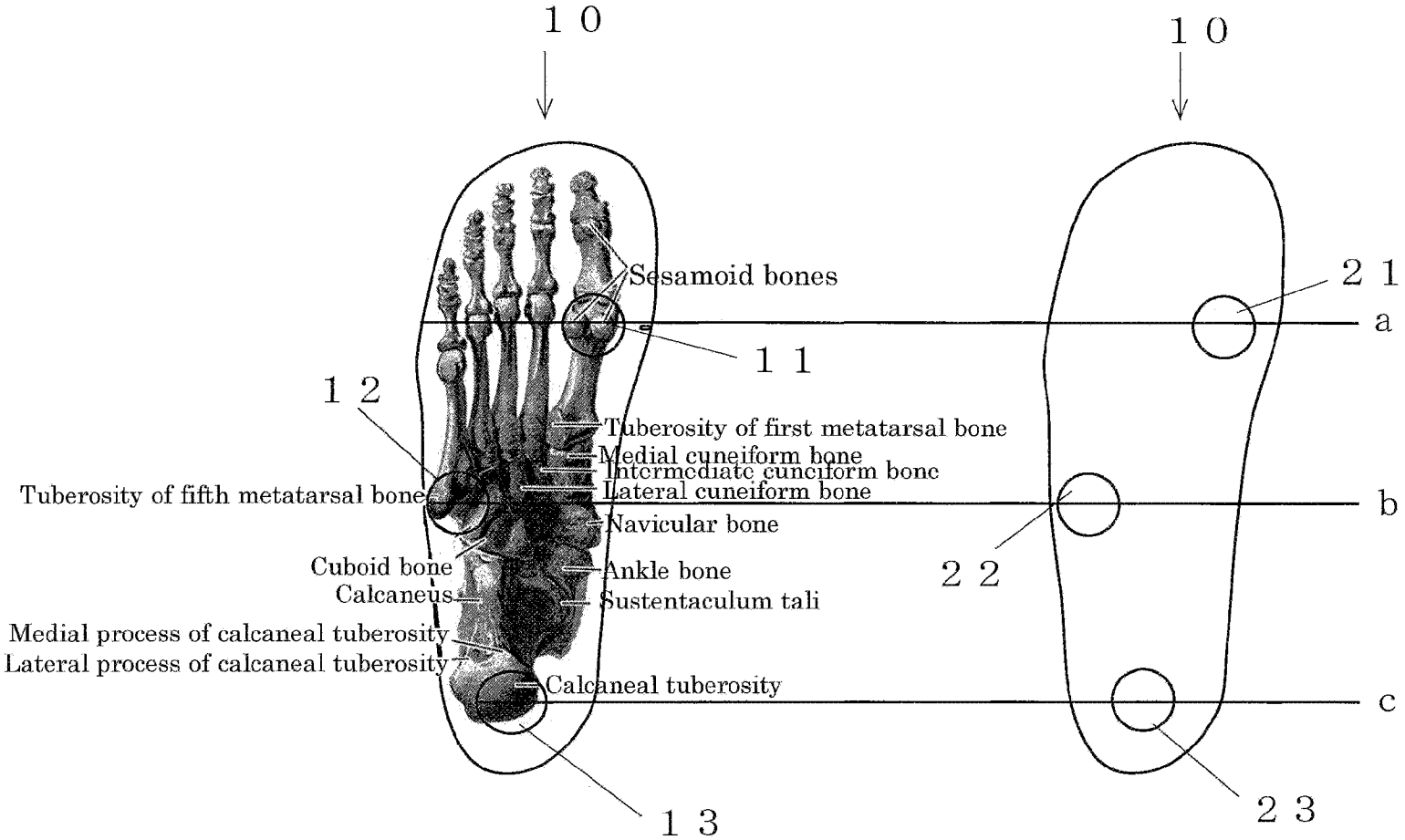
FIG. 3 is a backside view comparing positions of convex portions on a right insole and positions of bones of a right sole.

Although FIGS. 1 and 3 show bones of a right sole and an insole for a right sole, bones of a left sole and an insole for a left sole are mirror image objects.

A shoe insole of the present invention is to improve functional movements by improving a standing position and adjusting a center of gravity, and thus the insole is suitable not only for shoes routinely used, but also for functional shoes used on sports and the like.

Firstly, a skeletal structure of a foot will be explained to subsequently explain an embodiment of an insole of the present invention, regarding a structure, a function, and an action of the insole. FIG. 1 is a plan view illustrating a skeletal structure of a sole. This drawing is viewed from a bottom side.

FIG. 3 shows the shoe insole 10 having characteristic portions to stabilize a center of gravity by a three point balance. In the insole 10, the first metatarsal sesamoid bone contacting portion (convex portion) 21 contacts with the first metatarsal sesamoid bone 11; the tuberosity of fifth metatarsal bone contacting portion (convex portion) 22 contacts with the tuberosity of fifth metatarsal bone 12; and the calcaneal tuberosity contacting portion (convex portion) 23 contacts with the calcaneal tuberosity 13, respectively.

The insole 10 has a laminated structure consisting of the three layers, that is, the surface material layer 31, which is on a side with which a foot contacts; the middle base member layer 32; and the posting member layer 33, which is on a side with which a shoe contacts. Because shapes of feet are varied depending on individuals who use the insole, a thickness of each of portions can be made different each other, by changing a thickness of each of portions in the posting member layer 33.

For a general-purpose, several kinds of the insole 10 can be prepared in advance corresponding to common foot shapes. Also, to make unevenness on a surface material, attachable and detachable separated convex members can be fitted on a surface of a flat insole that is prepared in advance, or convex members can be fitted on a middle layer in a plurality of layers.

Figure 4:
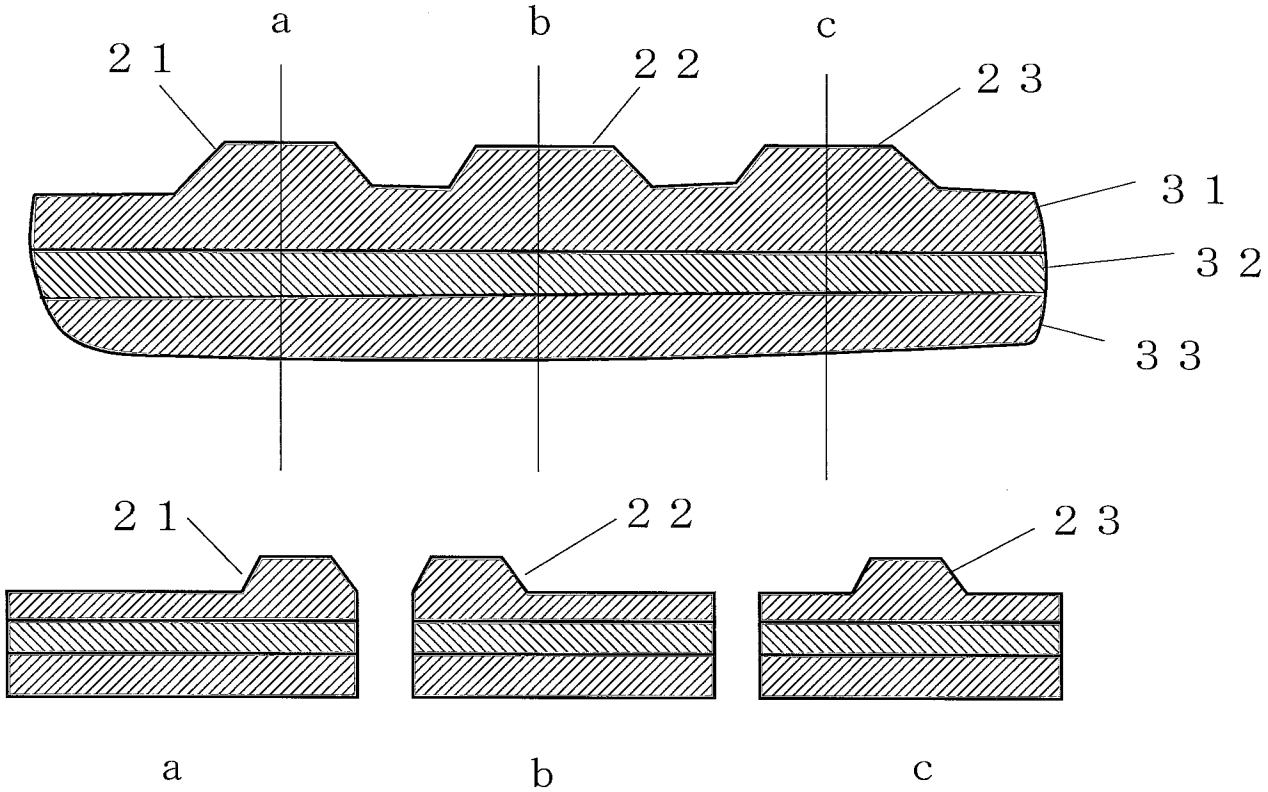
FIG. 4 is a cross sectional view illustrating a lateral face and a three-dimensional shape of a right insol.
Figure 5:
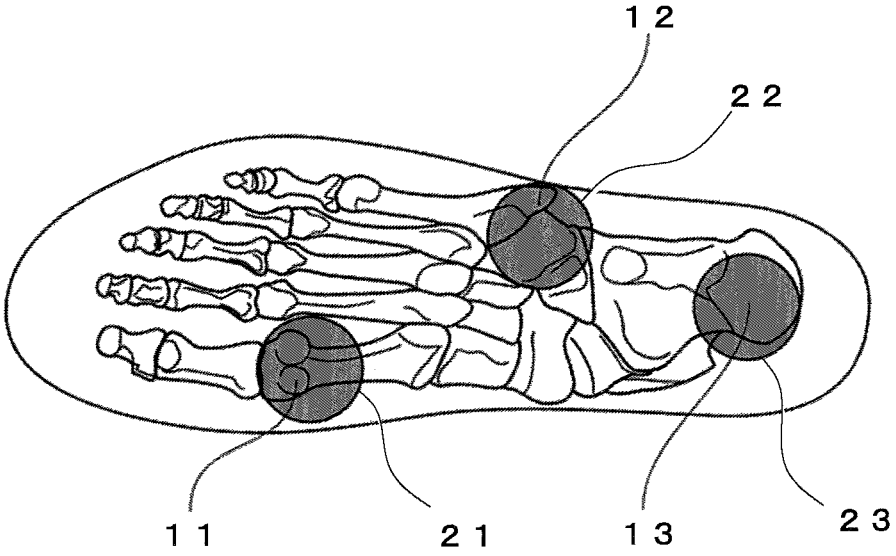
FIG. 5 is a plan view which is layered a plan view of right insole and a plan view of bones of a right sole.

As particularly shown in FIGS. 3 and 4, the insole 10 itself can easily be deformed to make it movable, and also it has a characteristic uneven structure in which the convex portions 21, 22, and 23 are formed on particular sites. The convex portions 21, 22, and 23 located on particular sites may be formed by separated convex members.

The present invention provides an insole that is restrained from moving and fitted on inside of a shoe to support a sole, in which a surface or a rear surface of the insole has convex portions to keep a three point balance when the insole is restrained from moving in the shoe. The convex portions support three points so that a center of gravity can be stabilized. Note that the convex portions 21, 22, and 23 can be replaced by concave portions, in which each of concave portions corresponds to each of the convex portions. According to this manner, the concave portions function similarly to the convex portions.

The present invention provides an insole that is restrained from moving and fitted on inside of a shoe to support a sole, and the insole has a shape in which a surface or a rear surface of the insole functions to keep a three point balance on a sole when the insole is restrained from moving in the shoe, and thereby gives a functional stress to a sole, and in which each of which three points corresponds to a first metatarsal sesamoid bone, a tuberosity of fifth metatarsal bone, and a calcaneal tuberosity respectively.

The insole 10 has a flat surface portion that contacts with a shoe on which the insole 10 is fitted, and the flat surface portion is located on a surface opposite to where the convex portions are provided, and the flat surface portion is allowed to be deformed by the convex portions. In this case, each of the convex portions can also be replaced by a concave portion.

Figure 6:
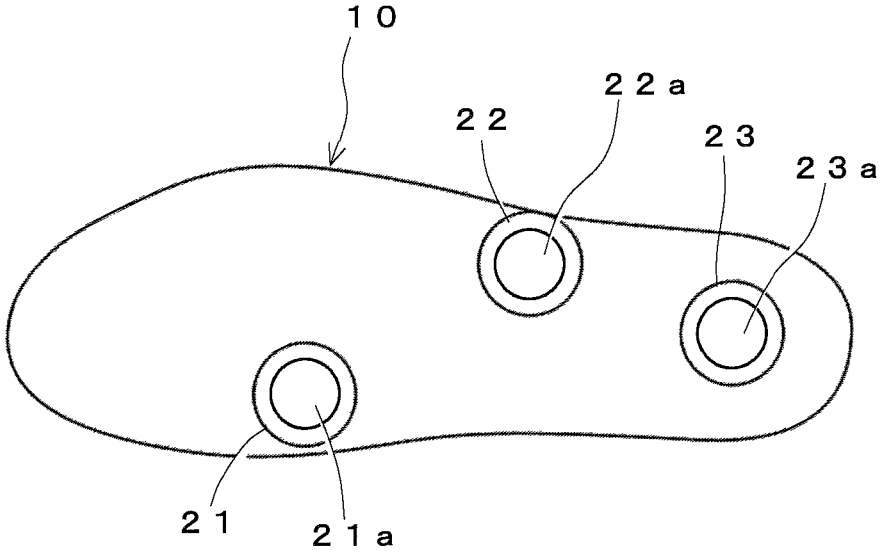
FIG. 6 is a plan view illustrating a right insole.
Figure 7:
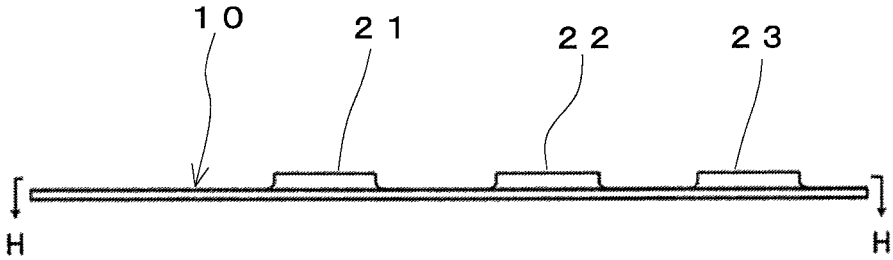
FIG. 7 is a side view illustrating a right insole.
Figure 8:
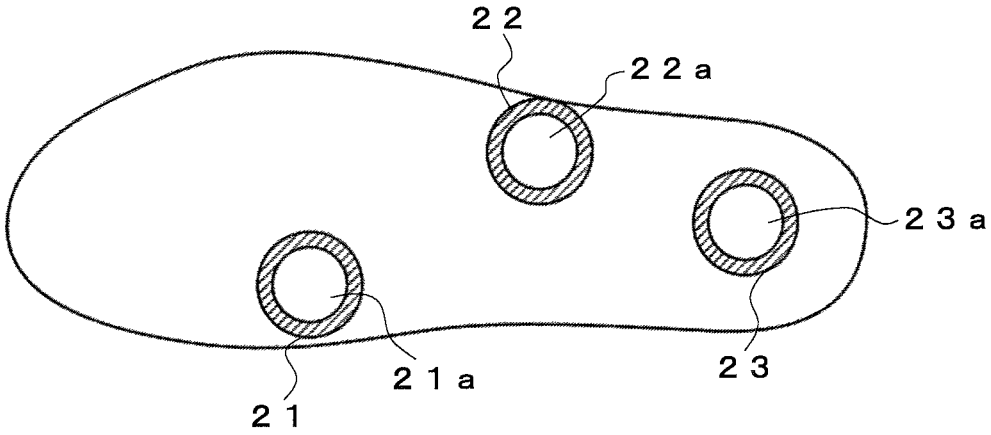
FIG. 8 is a cross-section view of FIG. 7 along the line H-H.

Meanwhile, as described in FIGS. 6, 7, and 8, circular concave portions 21*a*, 22*a*, and 23*a* may be shaped in center of convex portions 21, 22, and 23.

As detailed above, a shoe insole of the present invention can improve functional movements as it supports a sole at appropriate positions for three point balancing, which stabilizes a center of gravity and keeps a right position. In particular, an insole of the present invention can eliminate sequential disabilities caused by distortions of basal foot joints.

Although the particular structures have shown to explain the present invention in the embodiments described above, it is clear that partial modifications and the like can be made to the present invention.

REFERENCE SIGNS LIST

10. Insole
11. First metatarsal sesamoid bone
12. Tuberosity of fifth metatarsal bone
13. Calcaneal tuberosity
21. First metatarsal sesamoid bone contacting portion (convex portion)
22. Tuberosity of fifth metatarsal bone contacting portion (convex portion)
23. Calcaneal tuberosity contacting portion (convex portion)
21*a*, 22*a*, 23*a*. concave portions

What is claimed is:

1. An insole fitted to be restrained from moving inside of a shoe to support a sole of a person wearing the shoe, comprising:

a shape having a surface with three support points, the three support points maintaining balance on the sole and thereby giving a functional stress to the sole, wherein the three support points correspond to a position underneath a first metatarsal sesamoid bone, a position underneath a tuberosity of fifth metatarsal bone, and a position underneath a calcaneal tuberosity respectively, of the sole of the person wearing the shoe; and the three support points comprise a convex portion underneath the position of the first metatarsal sesamoid bone, a convex portion underneath the position of the tuberosity of fifth metatarsal bone, and a convex portion underneath the position of the calcaneal tuberosity.

2. The insole according to claim 1, wherein a concave portion is formed in a center of at least one of the convex portions.

* * * * *